US011457783B2

(12) United States Patent
Lee et al.

(10) Patent No.: US 11,457,783 B2
(45) **Date of Patent: *Oct. 4, 2022**

(54) CLEANER

(71) Applicant: LG ELECTRONICS INC., Seoul (KR)

(72) Inventors: Dongjae Lee, Seoul (KR); Moohyun Ko, Seoul (KR); Hyeri Kwon, Seoul (KR); Donggeun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 111 days.

This patent is subject to a terminal disclaimer.

(21) Appl. No.: 16/874,416

(22) Filed: May 14, 2020

(65) Prior Publication Data

US 2020/0383538 A1 Dec. 10, 2020

(30) Foreign Application Priority Data

Jun. 5, 2019 (KR) ..... 10-2019-0066950
Jul. 8, 2019 (KR) ..... 10-2019-0082291

(51) Int. Cl.
*A47L 9/10* (2006.01)
*A47L 9/16* (2006.01)
(Continued)

(52) U.S. Cl.
CPC ..... *A47L 9/108* (2013.01); *A47L 9/127* (2013.01); *A47L 9/1409* (2013.01); *A47L 9/1641* (2013.01); *A47L 9/32* (2013.01)

(58) Field of Classification Search
CPC ..... A47L 9/108; A47L 9/127; A47L 9/1409; A47L 9/1641; A47L 9/32
See application file for complete search history.

(56) References Cited

U.S. PATENT DOCUMENTS 3,368,232 A * 2/1968 Schwartzman ..... B65D 47/42 401/206
6,625,845 B2 9/2003 Matsumoto et al.
(Continued)

FOREIGN PATENT DOCUMENTS

CN 101849803 A 10/2010
CN 103300795 A 9/2013
(Continued)

*Primary Examiner* — Andrew A Horton
(74) *Attorney, Agent, or Firm* — Dentons US LLP

(57) ABSTRACT

Provided is a cleaner. The cleaner includes a housing provided with a dust container at a lower side thereof having a suction opening, a filter part configured to filter dust from air suctioned through the suction opening, the filter being spaced apart from an inner circumferential surface of the housing, a movable part configured to be elevated between a first position and a second position in a space between the outside of the filter part and the inner circumferential surface of the housing, a manipulation part of which at least a portion is exposed to outside of the housing, the manipulation part being elevated by user's manipulation, and a transfer unit of which at least a portion is accommodated in the housing, the transfer unit being configured to connect the manipulation part to the movable part. The dust container has an elevation groove, which is recessed outward from an inner surface of the dust container, in a vertical direction.

17 Claims, 11 Drawing Sheets

(51) Int. Cl.

| | |
|---|---|
| ***A47L 9/14*** | (2006.01) |
| ***A47L 9/12*** | (2006.01) |
| ***A47L 9/32*** | (2006.01) |

(56) References Cited

U.S. PATENT DOCUMENTS

| | | | | |
|---|---|---|---|---|
| 7,074,248 | B2 | 7/2006 | Jin et al. | |
| 10,299,648 | B2 | 5/2019 | Peters et al. | |
| 2001/0025395 | A1 | 10/2001 | Matsumoto et al. | |
| 2008/0056933 | A1* | 3/2008 | Moore | A47L 11/30 422/1 |
| 2008/0264015 | A1 | 10/2008 | Oh et al. | |
| 2009/0293221 | A1 | 12/2009 | Hwang et al. | |
| 2014/0020204 | A1 | 1/2014 | Haegermarck et al. | |
| 2018/0132685 | A1 | 5/2018 | Muir et al. | |

FOREIGN PATENT DOCUMENTS

| | | | |
|---|---|---|---|
| JP | H0630871 | A | 2/1994 |
| JP | 2002-315701 | A | 10/2002 |
| JP | 3699679 | B2 | 7/2003 |
| JP | 2003190056 | A | 7/2003 |
| JP | 2010-121190 | A | 6/2010 |
| JP | 2010-151327 | A | 7/2010 |
| JP | 2011-218100 | A | 11/2011 |
| KR | 10-2001-0090527 | A | 10/2001 |
| KR | 10-2004-0085308 | A | 10/2004 |
| KR | 10-2006-0098765 | A | 9/2006 |
| KR | 10-2018-0101457 | A | 9/2018 |
| WO | 00-52396 | A1 | 9/2000 |
| WO | 2016-104974 | A1 | 6/2016 |
| WO | 2016-051606 | A1 | 7/2016 |

* cited by examiner

CLEANER

CROSS-REFERENCE TO RELATED APPLICATIONS

The present application claims priority under 35 U.S.C. 119 and 35 U.S.C. 365 to Korean Patent Application No. 10-2019-0066950, filed on Jun. 5, 2019, which is hereby incorporated by reference in its entirety.

BACKGROUND

The present disclosure relates to a vacuum cleaner having a dust compression function.

Cleaners are devices that suctions or washes dusts or foreign substances on an object area to be cleaned so as to perform cleaning.

Cleaners may be classified into a manual cleaner that a user moves in person for cleaning and an automatic cleaner that automatically moves for cleaning.

Manual cleaners may fall into, depending on the types, a canister cleaner, an upright cleaner, a handy cleaner, and a stick cleaner.

Prior Art Document: US Patent Publication US2018/0132685A1

The prior art document discloses a cleaning mechanism including a dust compression part that compresses dust in a dust container.

The cleaning mechanism includes a dust container having an opening, a filter for purifying air in the dust container, a shroud surrounding the filter, a dust compression part disposed to surround the shroud, a handle manipulated by a user to allow the dust compression part to move, and a link connected to the handle.

Operation force of the handle is transmitted to the dust compression part through the link so that the dust compression part descends to compress the dust in the dust container.

According to the related art, when using a cleaner that does not have the dust compression function, if dust is accumulated in the dust container, it is forced to empty the dust container immediately. Therefore, the dust container is filled up quickly to decrease in cycle for emptying the dust container. As a result, there is a troublesome problem.

Also, there is a limitation that dust is blown when emptying the dust container.

However, like the prior art document, if the structure for compressing the dust container is applied, when the dust is filled in the dust container, a volume of the dust may be reduced by compressing the dust.

Therefore, the dust container does not need to be emptied frequently due to the dust compression, and there is an advantage in that the phenomenon of dust blowing when emptying the dust is reduced.

However, while the structure for compressing dust is provided inside the dust container, a limitation that dust enters a rail part along which the dust compression part moves occurs.

Particularly, in the dust container, when the dust compression part descends, the rail part above the dust compression part is opened to the outside, and dust is introduced into a gap.

As described above, when the dust in the dust container is introduced into the rail part, the dust acts as an obstacle to elevate the dust compression part so that the elevation operation of the dust compression part is not performed smoothly.

Particularly, when the dust compression part descends, the ascending operation of the dust compression part may be disturbed due to the dust caught in the rail part disposed above the dust compression part.

Also, the user has to apply large force to forcibly lift the dust compression part, and since the large force is applied to the dust compression part, the component such as the dust container or the dust compression part may be damaged.

Therefore, it is necessary to block the dust so that the dust of the dust container is not introduced into the rail part provided in the dust container.

SUMMARY

Embodiments provide a cleaner that compresses dust introduced into a dust container and blocks dust and foreign substances from the dust container into an elevation groove defined in the dust container during an elevation operation of a movable part and a transfer part.

Embodiments also provide a cleaner provided with a partition member that blocks an inlet of an elevation groove when a movable part descends to compress dusts within a dust container.

Embodiments also provide a cleaner provided with a partition member which maintains a blocked state of an inlet of an elevation groove regardless of whether a movable part is elevated without effecting an elevation operation of the movable part.

Embodiments also provide a cleaner in which a movable part and a transfer part, which are elevated to compress dust inside a dust container, are smoothly elevated.

In one embodiment, a cleaner includes a housing provided with a dust container at a lower side thereof having a suction opening and a movable part configured to be elevated between an upper side and a lower side of the dust container to compress dust within the dust container.

The cleaner may further include a filter part configured to filter dust from air suctioned through the suction opening, the filter being spaced apart from an inner circumferential surface of the housing.

The cleaner may further include an air guide configured to guide the air passing through the filter part in an inner region of the filter part to a suction motor configured to generate suction force.

The movable part may be elevated between a first position and a second position in a space between the outside of the filter part and the inner circumferential surface of the housing.

The cleaner may further include a manipulation part of which at least a portion is exposed to outside of the housing, the manipulation part being elevated by user's manipulation.

The cleaner may further include a transfer unit of which at least a portion is accommodated in the housing, the transfer unit being configured to connect the manipulation part to the movable part.

The transfer unit may include: a second transfer part extending upward from one side of the movable part; and a first transfer part configured to connect an upper side of the second transfer part to an upper side of the manipulation part.

The dust container may have an elevation groove defined vertically to be recessed outward from an inner surface of the dust container When the movable part is elevated, at least a portion of the second transfer part may be accommodated into and guided by the elevation groove.

A protruding body protruding outward by the elevation groove may be disposed on an outer surface of the housing.

The cleaner may further include a partition member provided at an inlet-side of the elevation groove to partition an inner space of the dust container and an inner surface of the elevation groove from each other.

The partition member may have a slit, through which the movable part and the connection part of the second transfer part pass, in a vertical direction.

The slit may be selectively opened and closed by an elevation operation of the connection part.

When the connection part descends, the slit may be closed, and when the connection part ascends, the slit may be opened.

The partition member may be opened and closed in a zipper manner or a zipper lock manner.

The partition member may be made of a cushion material having elasticity or flexibility.

The partition member may be made of a brushed material.

The partition member may be made of a rubber or silicon material.

The partition member may be provided on each of both sides of the inlet-side of the elevation groove, wherein ends of the partition members, in which the slits are defined, may at least partially overlap each other.

The partition member may be provided on each of both sides of the inlet-side of the elevation groove, wherein ends of the partition members, in which the slits are defined, may at least partially surface-contact each other.

The movable part may be elevated between upper and lower ends of the dust container.

A portion of the manipulation part, which is exposed to the outside of the housing, may extend in a horizontal direction.

The cleaner may further include an elastic member providing elastic force to the manipulation part or the transfer unit.

The elastic member may provide force that pushes the manipulation part upward.

A support bar extending vertically may be installed outside the housing, and the elastic member may be inserted into an outer circumferential surface of the support bar.

A handle part may be disposed outside the housing, and the manipulation part may be disposed adjacent to one side of the handle part.

The details of one or more embodiments are set forth in the accompanying drawings and the description below. Other features will be apparent from the description and drawings, and from the claims.

DETAILED DESCRIPTION OF THE EMBODIMENTS

Figure 1:
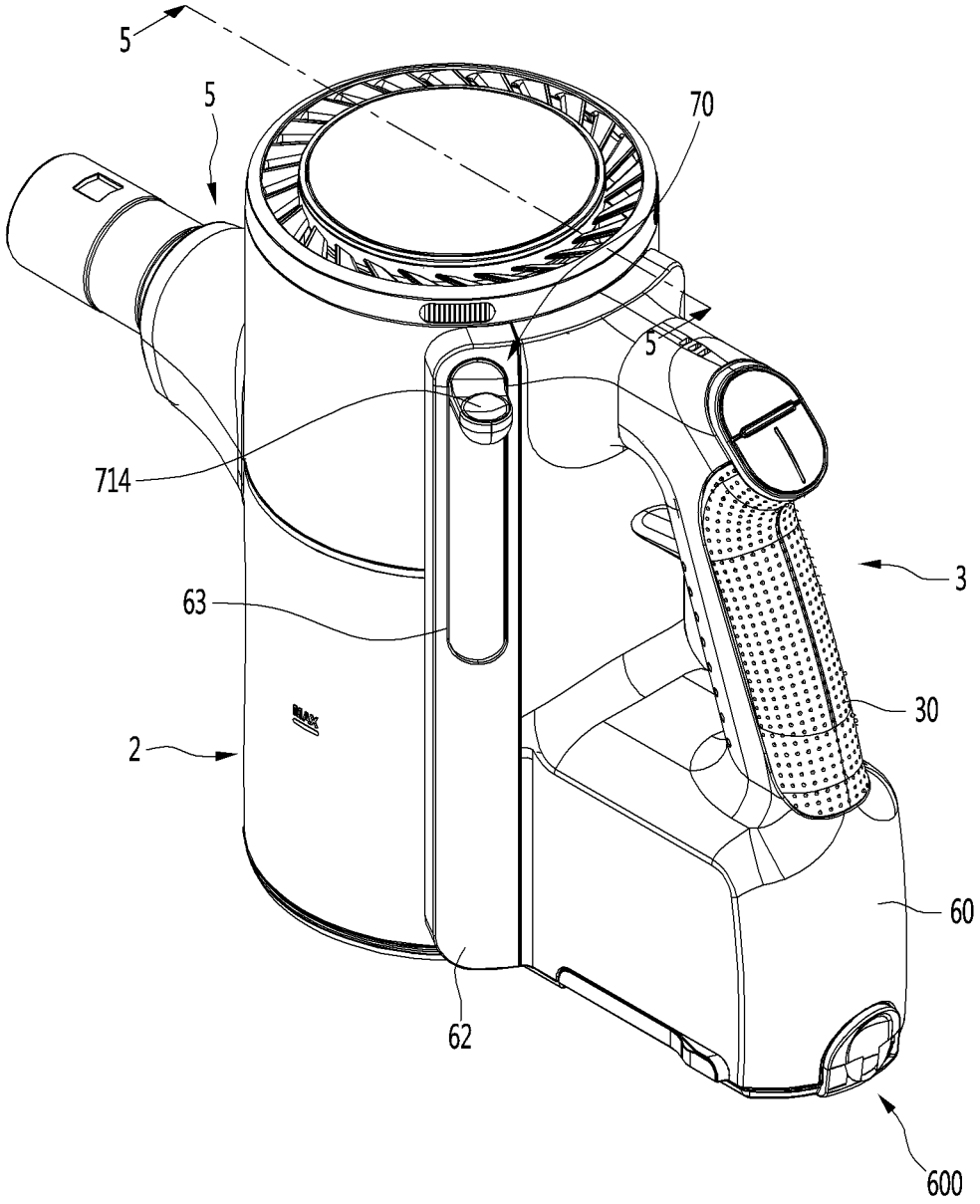
FIG. 1 is a perspective view of a cleaner according to an embodiment.

Hereinafter, some embodiments of the present invention will be described in detail with reference to the accompanying drawings. Exemplary embodiments of the present invention will be described below in more detail with reference to the accompanying drawings. It is noted that the same or similar components in the drawings are designated by the same reference numerals as far as possible even if they are shown in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", "coupled" or "joined" to the latter with a third component interposed therebetween.

Figure 2:
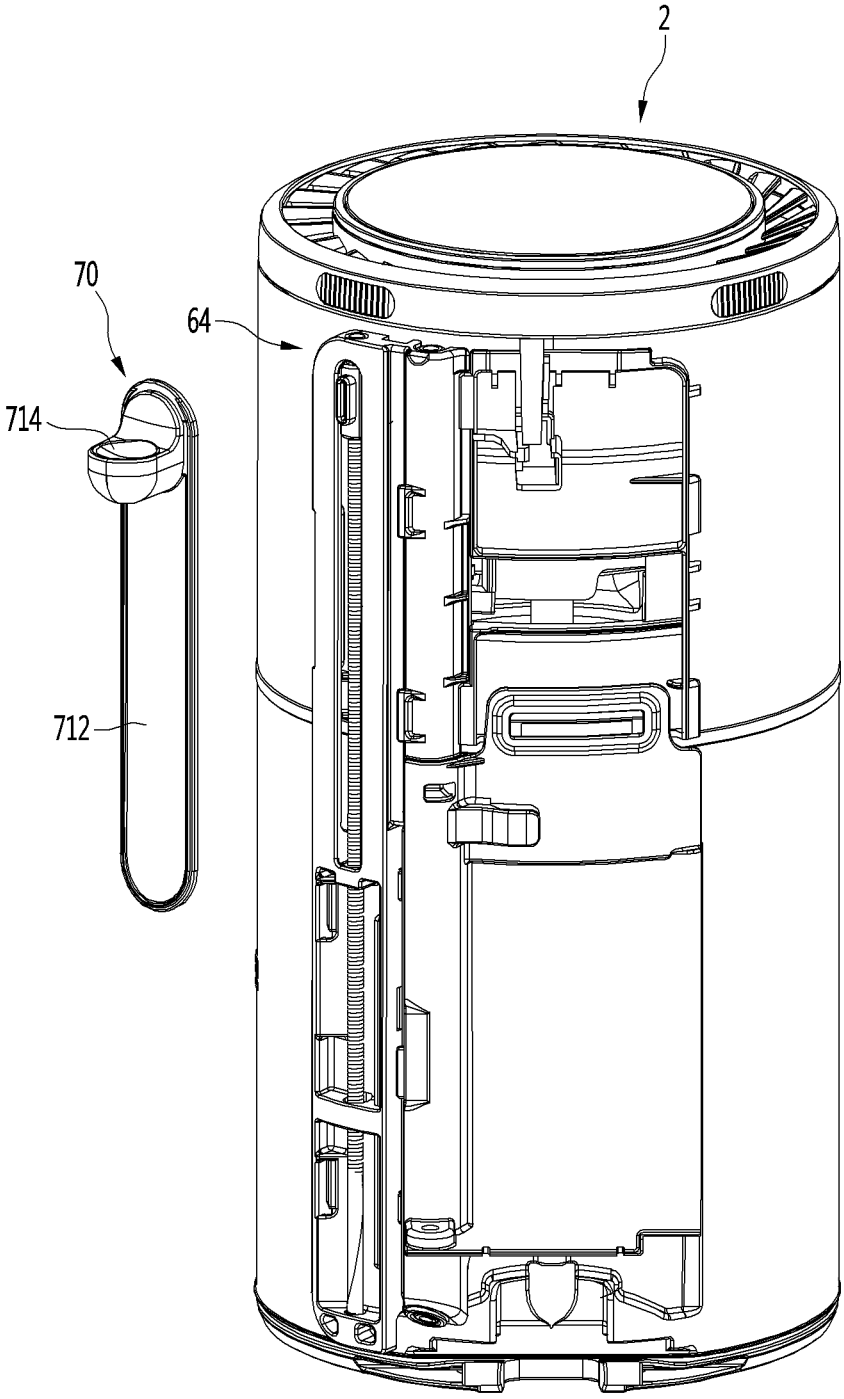
FIG. 2 is a perspective view illustrating a state in which a handle part is separated from the cleaner according to an embodiment.
Figure 3:
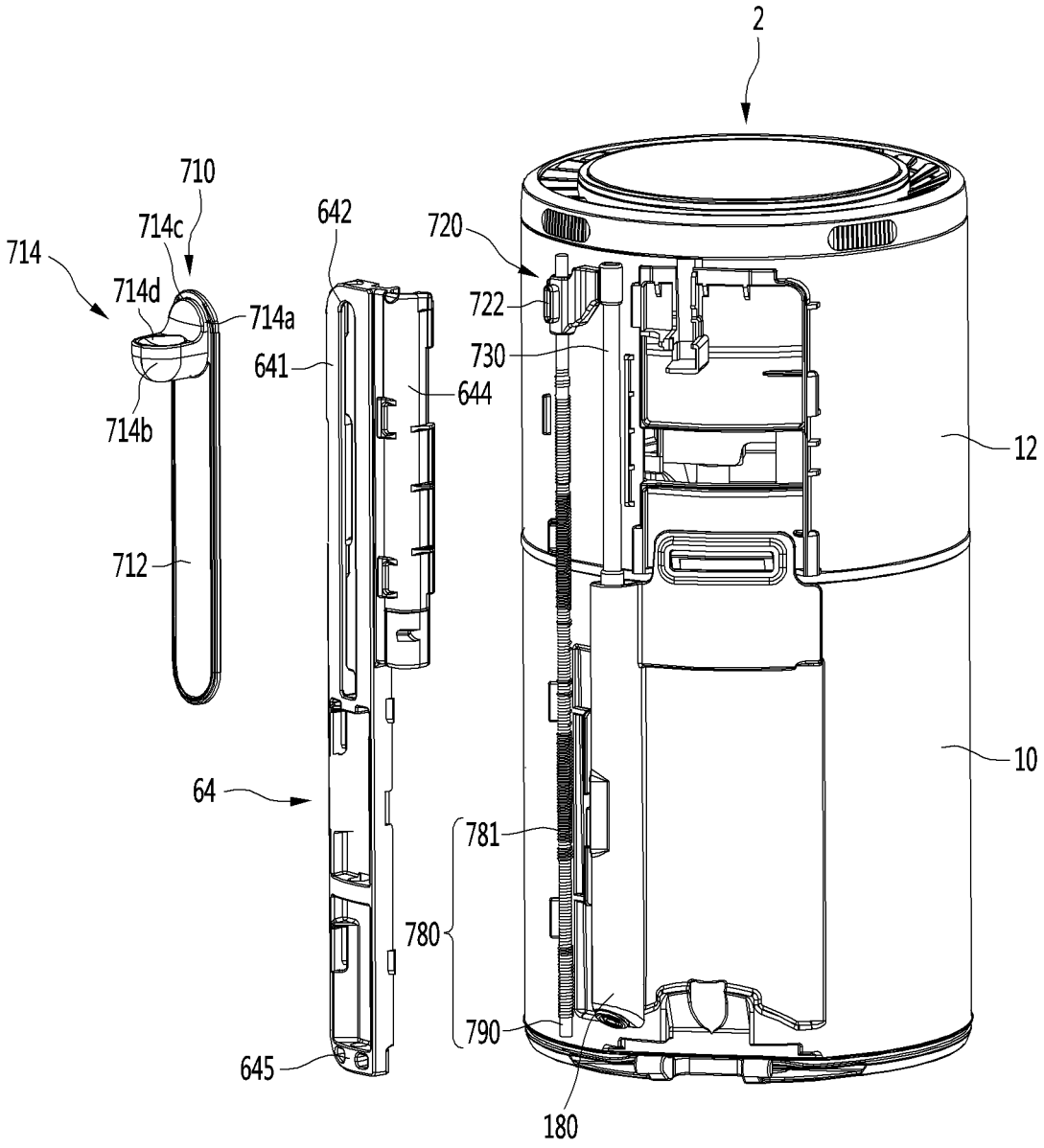
FIG. 3 is a view illustrating a state in which a guide frame is separated in FIG. 2.
Figure 4:
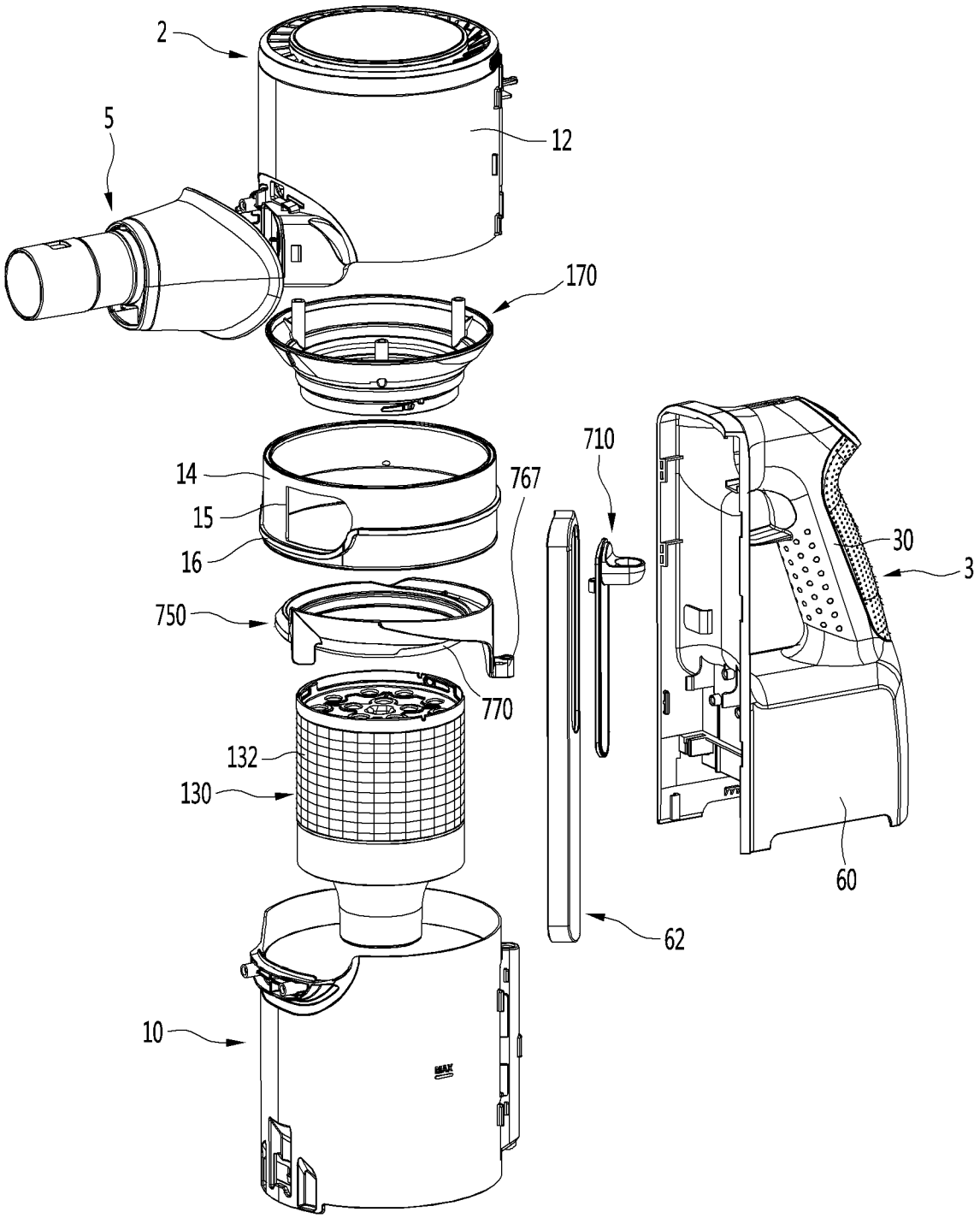
FIG. 4 is an exploded perspective view of the cleaner according to an embodiment.
Figure 5:
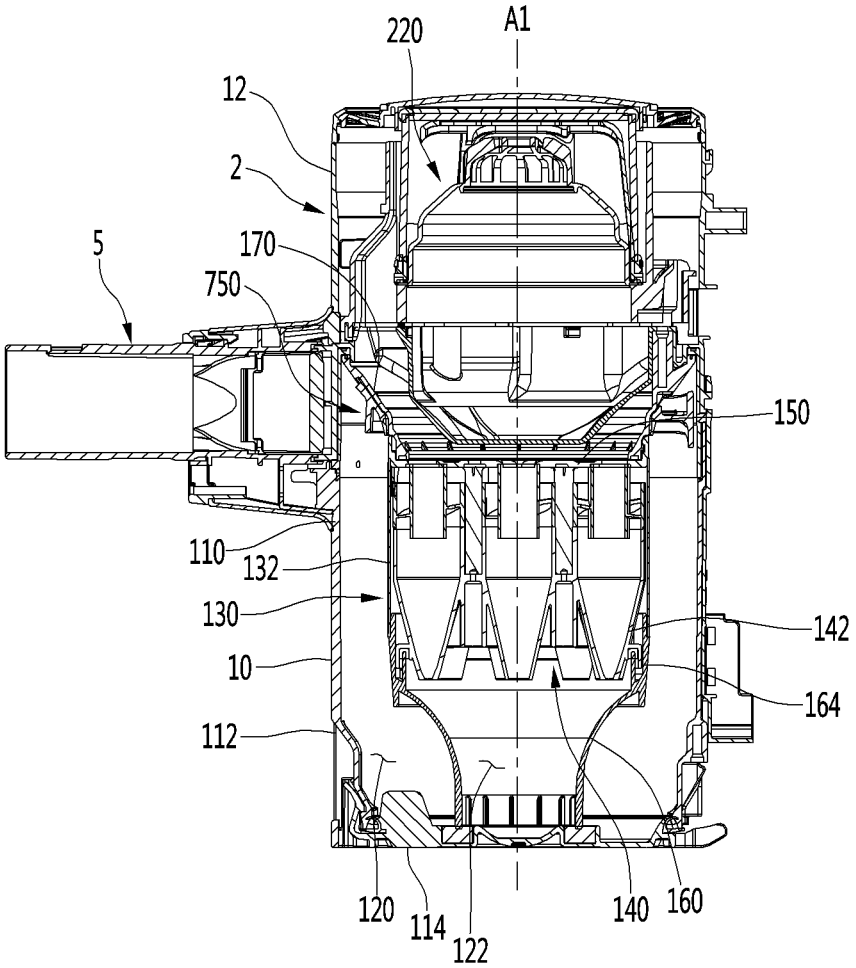
FIG. 5 is a cutaway cross-sectional view taken along line 5-5 of FIG. 1.

FIG. 1 is a perspective view of a cleaner according to an embodiment, FIG. 2 is a perspective view illustrating a state in which a handle part is separated from the cleaner according to an embodiment, FIG. 3 is a view illustrating a state in which a guide frame is separated in FIG. 2, and FIG. 4 is an exploded perspective view of the cleaner according to an embodiment. FIG. 5 is a cutaway cross-sectional view taken along line 5-5 of FIG. 1.

Referring to FIGS. 1 to 5, a cleaner 1 according to an embodiment may include a main body 2. The cleaner 1 may include a suction part 5 through which air containing dust is suctioned. The suction part 5 may guide air containing dust into the main body 2.

The cleaner 1 may further include a handle part 3 coupled to the main body 2. The handle part 3 may be disposed at a side that is opposite to the suction part 5 in the main body 2. However, the positions of the suction part 5 and the handle part 3 are not limited thereto.

The main body 2 may separate dust suctioned into the inside thereof through the suction part 5 to store the separated dust.

For example, the main body 2 may include a dust separator. The dust separator may include a first cyclone part 180 that is capable of separating dust through a cyclonic flow. The first cyclone part 110 may communicate with the suction part 5.

The air and dust suctioned through the suction part 5 helically flow along an inner circumferential surface of the first cyclone part 180.

The dust separator may further include a second cyclone part 140 that secondarily separates dust from the air discharged out of the first cyclone part 110.

The second cyclone part 140 may include a plurality of cyclone bodies that are disposed in parallel to each other. The air may be divided to pass through the plurality of cyclone bodies 142.

For another example, it may be also possible that the dust separator has a single cyclone part.

For example, the main body 2 may have a cylindrical shape, and an outer appearance of the main body 2 may be defined by a plurality of housings.

For example, the main body 2 may include a substantially cylindrical first housing 10 and a substantially cylindrical second housing 12 coupled to an upper side of the first housing 10.

An upper side of the first housing 10 may define the first cyclone part 110, and a lower side of the first housing 10 may define the dust container 112 in which the dust separated in the first cyclone part 110 is stored.

The lower side of the first housing 10 (i.e., a lower side of the dust container 112) may be opened and closed by a housing cover 114 that rotates by a hinge.

To seal a boundary between the first housing 10 and the second housing 12 in a state in which the first housing 10 and the second housing 12 are coupled to each other, the cleaner 1 may further include a sealing member 16 and a support body 14 supporting the sealing member 16.

The first housing 10 and the second housing 12 have opened upper and lower sides, respectively. That is, the housings 10 and 12 may have an upper opening and a lower opening, respectively.

The support body 14 may have a cylindrical shape. Here, an outer diameter of the support body 14 may be equal to or less than an inner diameter of the first housing 10 so that the support body 14 is inserted into the first housing 10 through the upper opening of the first housing 10.

The outer diameter of the support body 14 may be equal to or less than an inner diameter of the second housing 12 so that the support body 14 is inserted into the second housing 12 through the lower opening of the second housing 12.

The support body 14 may include a communication opening 15 through which air passes.

The sealing member 16 may be coupled to the support body 14 to surround an outer circumferential surface of the support body 14. For example, the sealing member 16 may be integrated with the support body 14 by insert-injection. Alternatively, the sealing member 16 may be coupled to an outer circumferential surface of the support body 14 by an adhesive.

The main body 2 may include a suction opening (see reference numeral 12*a* of FIG. 12) through which air guided through the suction part 5 is introduced.

For example, one of the first housing 10 and the second housing 12 may have the suction opening (see reference numeral 12*a* of FIG. 12), or the first housing 10 may define one portion of the suction opening (see reference numeral 12*a* of FIG. 12), and the second housing 12 may define the other portion of the suction opening (see reference numeral 12*a* of FIG. 12).

Hereinafter, a structure in which the second housing 12 includes the suction opening (see reference numeral 12*a* of FIG. 12) will be described as an example.

When the second housing 12 is coupled to the first housing 10, the suction opening 12*a* of the second housing 12 and the communication opening 15 of the support body 14 are aligned with each other.

The suction opening 12*a* is aligned with the suction part 5. Thus, dust and air may be introduced into the first cyclone part 110 through the inside of the suction part 5, the suction opening 12*a*, and the communication opening 15.

In this embodiment, the support body 14 may be omitted. In this case, an upper end of the first housing 10 may directly contact a lower end of the second housing 12. Also, dust and air may be introduced into the first cyclone part 110 through the suction opening 12*a* after passing through the inside of the suction part 5.

In this specification, a constituent for guiding the air from the suction part 5 to the first cyclone part 110 may be referred to as a suction passage of the main body 2.

In summary, the suction passage may include only the suction opening 12*a* or may include the suction opening 12*a* and the communication opening 15.

The body 2 may further include a filter part 130 disposed to surround the second cyclone part 140.

For example, the filter part 130 has a cylindrical shape and guides the air separated from the dust in the first cyclone part 110 to the second cyclone part 140. The filter part 130 filters dust while air passes therethrough.

For this, the filter part 130 may include a mesh portion 132 having a plurality of holes. The mesh portion 132 is not limited, but may be made of a metal material.

Since the mesh portion 132 filters the air, dust may be accumulated on the mesh portion 132, and thus, the mesh portion 132 needs to be cleaned.

Thus, according to an embodiment, the cleaner 1 may further include a cleaning mechanism 70 for cleaning the filter part 130.

The cleaning mechanism 70 includes a movable part 750 movable in the main body 2, a manipulation part 710 manipulated by a user to allow the movable part 750 to move, and transfer units 720 and 730 that transfer operation force of the manipulation part 710 to the movable part 750.

The manipulation part 710 may be disposed outside the main body 2. For example, the manipulation part 710 may be disposed outside the first housing 10 and the second housing 12.

Also, the manipulation part 710 may be disposed adjacent to the handle part 3. Thus, the user may easily manipulate the manipulation part 710 disposed near the handle part 3 when dust compression is needed while the user grips the handle part 3.

Also, at least a portion of the manipulation part 710 may be disposed higher than the second housing 10. Also, at least a portion of the manipulation part 710 may be disposed higher than the movable part 750.

The guide part 710 may include a pressing portion 714. The pressing portion 714 may be disposed higher than the first housing 10 and the movable part 750.

In the manipulation part 710, a portion at which the pressing portion 714 is disposed may extend horizontally, and the pressing portion 714 may be recessed downward.

The manipulation part 710 may further include a manipulation part body 712. The manipulation part body 712 may have a vertical length that is relatively longer than a left-right width thereof. The pressing portion 714 may protrude upward from the manipulation part body 712.

The pressing portion 714 may protrude from the manipulation part body 712 in a horizontal direction while the manipulation part body 712 is disposed in a vertical direction.

For example, the pressing portion 714 may be disposed closer to an upper end than a lower end of the manipulation part body 712.

The pressing portion 714 may protrude from a position that is spaced downward from an upper end of the manipulation part body 712.

The pressing portion 714 may include a first portion 714*a* protruding from the manipulation part body 712 and a second portion 714*b* additionally protruding from the first pressing portion 714*a*.

The second portion 714*b* may protrude from a position that is spaced downward from an upper end of the first portion 714*a* by a predetermined distance.

The user may press a top surface 714*d* of the second portion 714*b* to allow the manipulation part 710 to move downward. Thus, the top surface 714*d* of the second portion 714*b* serves as a pressing surface.

The manipulation part 710 may further include a coupling protrusion (see reference numeral 716 of FIG. 6) disposed at an opposite side of the pressing portion 714 from the manipulation part body 712.

The handle part 3 may include a handle body 30 for the gripping of the user and a battery housing 60 disposed below the handle body 30 to accommodate a battery 600.

The handle body 30 and the battery housing 60 may be disposed in the vertical direction, and the handle body 30 may be disposed above the battery housing 60.

The handle part 3 may guide the movement of the manipulation part 710 while covering a portion of the manipulation part 710.

For example, the handle part 3 may further include a manipulation part cover 62. The manipulation part cover 62 may be disposed at a side of the handle body 30 and the battery housing 60.

The manipulation part cover 62 may be integrated with the handle body 30 and the battery housing 60 or may be separately provided.

When the manipulation part cover 62 is separately provided with respect to the handle body 30 and the battery housing 60, the manipulation part cover 62 may be coupled to the main body 2.

The manipulation part 710 may be disposed at a left side of the handle body 30 while the user grips the handle body 30 with his right hand.

Thus, the manipulation part 710 may be easily manipulated with the left hand that does not grip the handle body 30.

The manipulation part 710 may move in a direction parallel to an axis A1 of the cyclone flow of the first cyclone part 110.

For example, the axis A1 of the cyclone flow of the first cyclone part 110 may extend in the vertical direction in a state in which the dust container 112 is placed on the floor.

Thus, the manipulation part 710 may also move in the vertical direction in the state in which the dust container 112 is placed on the floor.

A slot 63 may be defined in the manipulation part cover 62 to allow the manipulation part 710 to move therethrough. The pressing portion 714 of the manipulation part 710 may pass through the slot 63.

The vertical length of the manipulation part body 712 may be longer than a length of the slot 63. The left-right width of the manipulation part body 712 may be longer than that of the slot 63.

The left-right width of the pressing portion 714 may be equal to or smaller than that of the slot 63. The vertical length of the pressing portion 714 may be smaller than that of the slot 63.

A protruding length of the pressing portion 714 may be larger than a front-rear width of the manipulation part cover 62.

Thus, the pressing portion 714 may pass through the slot 63 and may protrude to the outside of the manipulation part cover 62 in the state of passing through the slot 63.

The left-right width of the manipulation part body 712 may be smaller than that of the manipulation part cover 62. The vertical length of the manipulation part body 712 may be smaller than the left-right width of the manipulation part cover 62.

The front-rear width of the manipulation part body 712 may be smaller than that of the manipulation part cover 62. The manipulation part cover 62 may define a space in which the manipulation part body 712 is disposed. The manipulation part body 712 may move upward and downward in the state in which the manipulation part body 712 is disposed in the manipulation part cover 62.

The manipulation part body 712 may move between a first position and a second position within the manipulation part cover 62.

The first position is a position when the manipulation part body 712 moves to the uppermost side, and the second position is a position when the manipulation part body 712 moves to the lowermost side.

The manipulation part body 712 may be disposed at the first position in a state in which no external force is applied to the manipulation part 710.

The manipulation part body 712 may cover the slot 63 in the state in which the manipulation part body 712 is disposed at the first position.

For example, in the state in which the manipulation part body 712 is disposed at the first position, the manipulation part body 712 may cover the entirety of the slot 63 inside the manipulation part cover 62. Thus, the manipulation part body 712 may be exposed to the outside of the slot 63 in the state in which the manipulation part body 712 is disposed at the first position, and a space inside the manipulation part cover 62 may be prevented from being exposed to the outside.

The slot 63 may also extend in a direction parallel to the extension direction of the axis A1 of the cyclone flow of the first cyclone portion 110.

In this embodiment, since the extension direction of the axis A1 of the cyclone flow is the vertical direction as an example in the drawing, the "vertical direction" described below may be understood as the extension direction of the axis A1 of the cyclone flow.

Since the movable part 750 is disposed in the main body 2, and the manipulation part 710 is disposed outside the main body 2, a portion of each of the transfer units 720 and 730 may be disposed outside the main body 2, and the other portion may be disposed inside the main body 2 so that the movable part 750 and the manipulation part 710 are connected to each other.

A portion of each of the transfer units 720, 730 may pass through the body 2. A portion of each of the transfer units 720 or 730 disposed outside the main body 2 may be covered by the handle part 3.

The transfer units 720 and 730 may include a first transfer part 720. The first transfer part 720 may be coupled to the manipulation part 710. For example, the first transfer part 720 may include a coupling protrusion 722. The coupling protrusion 722 may be coupled to the coupling protrusion 722 disposed on the manipulation part body 712.

The coupling protrusion 722 may have a vertical length greater than a left-right width thereof. The coupling protrusion 722 may limit relative rotation of the manipulation part 710 in the horizontal direction with respect to the first transfer part 720.

The transfer units 720 and 730 may further include a second transfer part 730 coupled to the movable part 750.

A portion of the second transfer part 730 may be disposed inside the main body 2, and the other part may be disposed outside the main body 2.

The second transfer part 730 may be directly connected to the first transfer part 720 or may be connected by an additional transfer part.

In FIG. 3, for example, the second transfer part 730 is directly connected to the first transfer part 720.

The main body 2 may further include a protruding body 180 for guiding the second transfer part 730. For example, the protruding body 180 protrudes to the outside of the first housing 10.

The protruding body 180 may extend in a direction parallel to the extension direction of the axis A1 of the cyclone flow of the first cyclone part 110.

The protruding body 180 may communicate with an internal space of the first housing 10, and the second transfer part 730 may move in the protruding body 180. For reference, since the protruding body 180 is provided, an elevation groove 190 (see FIG. 8) may be defined vertically inside the dust container 112.

The cleaner 1 may further include a support mechanism 780 for elastically supporting the cleaning mechanism 70.

The support mechanism 780 may include an elastic member 781 for providing elastic force to the cleaning mechanism 70.

The elastic member 781 may provide elastic force to the manipulation part 710 or the transfer units 720 and 730.

The elastic member 781 has elastic restoring force to provide force for allowing the manipulation part 710 to return to a first position (that is a position of the manipulation part 710 before the user presses the manipulation part 710).

For example, the elastic member 781 provides force for pushing the manipulation part 710 upward.

As described above, when the elastic member 781 provides force for pushing the manipulation part 710 upward, the user presses the manipulation part 710 downward to compress dust, and then, when the user takes his/her hands off from the manipulation part 710 or release the pressing force, the manipulation part 710 move upward by itself by the elastic restoring force of the elastic member 781 to return to its original position (first position).

Hereinafter, a structure in which the elastic member 781 supports the manipulation part 710 will be described as example.

The elastic member 781 may be spaced apart from the second transfer part 730 in a horizontal direction.

The elastic member 781 may be, for example, a coil spring and may be contracted and expanded in the vertical direction.

Here, a length of the elastic member 781 may be longer than that of the second transfer part 730 at the first position (the position of the manipulation part 710 before the user presses the manipulation part 710) of the manipulation part 710.

When the length of the elastic member 781 is longer than that of the second transfer part 730, the manipulation part 710 may be supported using the elastic member 781 having a low elastic modulus.

In this case, when pressing the manipulation part 710, the required force may be reduced. In addition, when the manipulation part 710 returns to its original position by the elastic member 781, noise generated while an upper end 714*c* of the first portion 714*a* collides with a surface defining the slot of the manipulation part cover 62 may be reduced in the pressing portion 714.

The support mechanism 780 may further include a support bar 790 that supports the elastic member 781 so that the horizontal movement of the elastic member 781 is limited during the vertical movement of the manipulation part 710.

For example, the support bar 790 may have a cylindrical shape. A vertical length of the support bar 790 may be longer than that of the elastic member 781.

The elastic member 781 may be disposed to surround the support bar 790.

That is, the support bar 790 may be disposed in an inner region of the coil-shaped elastic member 781. An outer diameter of the support bar 790 may be equal to or smaller than an inner diameter of the elastic member 781.

One end of the support bar 790 may be fixed to the main body 2 or a transfer unit cover that will be described below. The first transfer part 720 may be coupled to the other end of the support bar 790.

Figure 6:
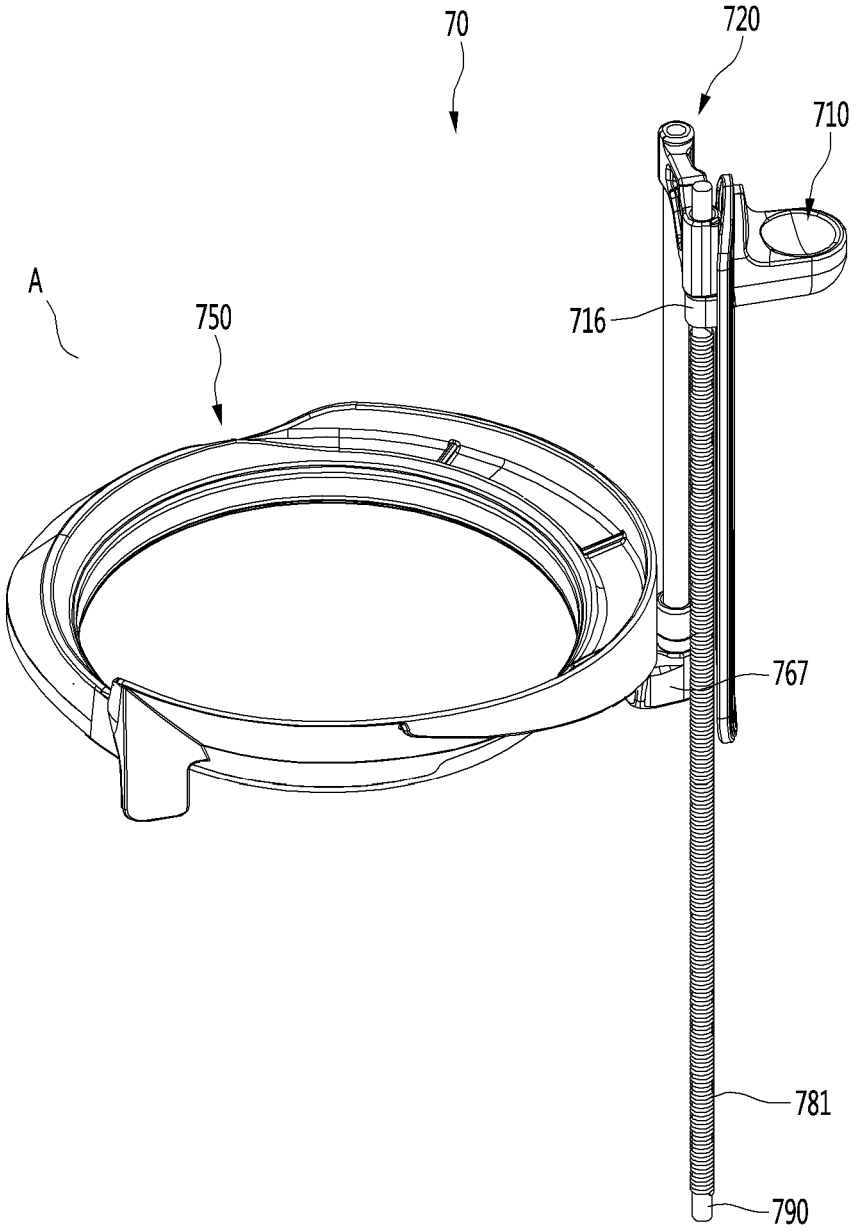
FIGS. 6 and 7 are perspective views of a cleaning mechanism according to an embodiment.

Here, the support bar 790 may be coupled to the first transfer part 720 after passing through the coupling protrusion (see reference numeral 716 of FIG. 6). A portion of the coupling protrusion (see reference numeral 716 of FIG. 6) may be coupled to the first transfer part 720.

An upper end of the elastic member 781 may contact a lower side of the coupling protrusion (see reference numeral 716 of FIG. 6).

The other end of the support bar 790 may be an upper end. An upper end of the support bar 790 may be coupled to pass through the first transfer part 720.

The first transfer part 720 may move vertically along the support bar 790. Thus, the support bar 790 may guide the vertical movement of the first transfer part 720. Thus, the support bar 790 may be called a guide bar.

The cleaner 1 may further include the transfer unit cover 64 covering the transfer units 720 and 730.

The transfer unit cover 64 may be coupled to the main body 2 while covering the transfer units 720 and 730.

The transfer unit cover 64 may also cover the support mechanism 780.

A first portion 641 of the transfer unit cover 64 may cover the first transfer part 720, the support bar 790, and the elastic member 781 at a side of the protruding body 180.

A second portion 644 of the transfer unit cover 64 may be disposed above the protruding body 180 and may cover the second transfer portion 730.

The transfer unit cover 64 may include a slot 642 in which the coupling protrusion 722 of the first transfer part 720 is disposed. The slot 642 may be defined long in the vertical direction.

The transfer unit cover 64 may be provided with a bar coupling part 645 to which the support bar 790 is coupled.

The main body 2 may further include a suction motor 220 for generating suction force. The suction force generated by the suction motor 220 may act on the suction part 5.

For example, the suction motor 220 may be disposed in the second housing 12.

The suction motor 220 may be disposed above the dust container 112 and the battery 600 with respect to the extension direction of the axis A1 of the cyclone flow of the first cyclone part 110.

The main body 2 may further include an air guide 170 for guiding air passing through the filter part 130 to the suction motor 220.

For example, the air guide 170 may guide the air discharged from the second cyclone part 140 to the suction motor 220.

The second cyclone part 140 may be coupled to a lower side of the air guide 170. The filter part 130 may surround the second cyclone part 140 in the state in which the filter part 130 is coupled to the second cyclone part 140.

Thus, the filter part 130 may also be disposed below the air guide 170. The movable part 750 may be disposed at a position at which the movable part 750 surrounds the air guide 170 at a standby position.

The movable part 750 may include a cleaning part 770 for cleaning the filter part 130.

In this embodiment, a position of the movable part 750 in the state in which the manipulation part 710 is not manipulated (an initial position of the manipulation part 710) may be referred to as a standby position.

At the standby position of the movable part 750, the entire the cleaning part 770 may be disposed so as not to overlap the filter part 130 in a direction in which air passes through the filter part 130.

For example, the entire cleaning part 770 may be disposed higher than the filter part 130 at the standby position of the movable part 750.

Thus, at the standby position of the movable part 750, it is possible to prevent the cleaning part 770 from acting as flow resistance while the air passes through the filter part 130.

The dust guide 160 may be provided below the second cyclone part 140. A lower side of the second cyclone part 140 may be coupled to an upper side of the dust guide 160. Also, a lower side of the filter part 130 may be seated on the dust guide 160.

The lower side of the dust guide 160 may be seated on the body cover 114. The dust guide 160 is spaced apart from an inner circumferential surface of the first housing 10 to partition the inner space of the first housing 10 into a first dust storage part 120 in which dust separated in the first cyclone part 110 is stored and a second dust storage part 122 in which dust separated in the second cyclone part 140 is stored.

The inner circumferential surface of the first housing 10 and an outer circumferential surface of the dust guide 160 may define the first dust storage part 120, and an inner circumferential surface of the dust guide 160 may define the second dust storage part 122.

Hereinafter, the cleaning mechanism 70 will be described in more detail.

Figure 7:
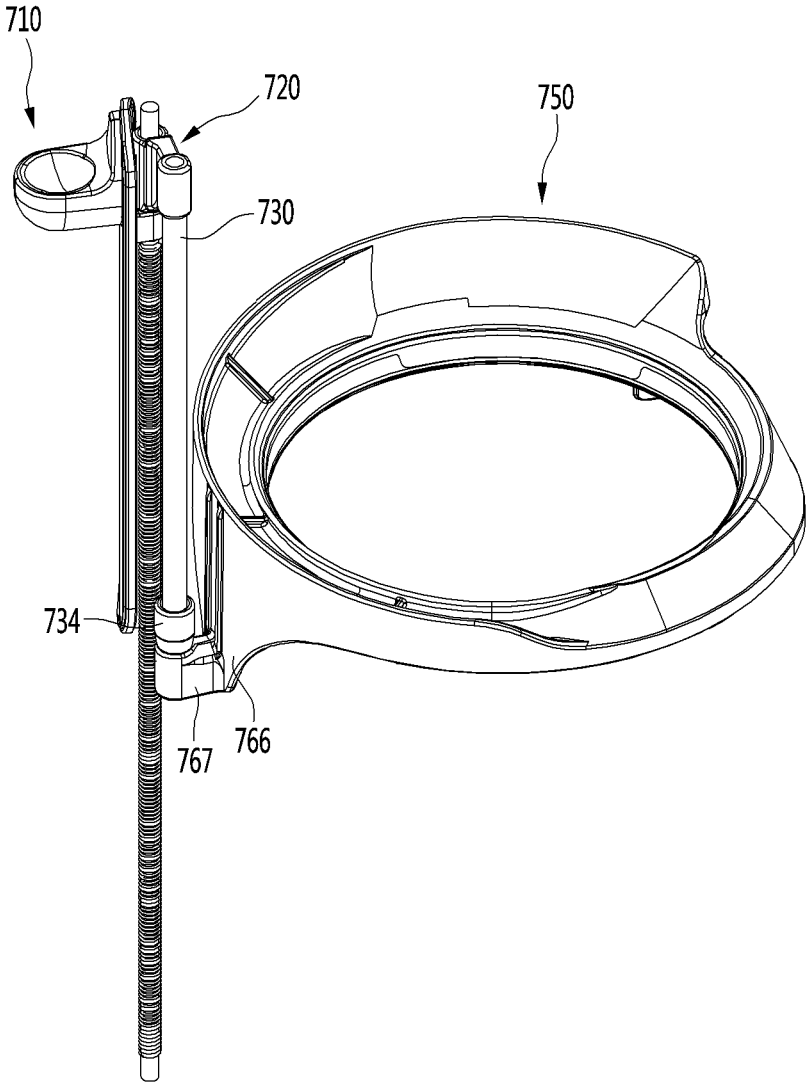

FIGS. 6 and 7 are perspective views of the cleaning mechanism according to an embodiment.

Referring to FIGS. 6 and 7, the movable part 750 may include a cleaning part 770 for cleaning the filter part 130 and a frame 760 supporting an outer circumference of the cleaning part 770.

A maximum diameter of the frame 760 may be smaller than a diameter of the inner circumferential surface of the first cyclone part 110. Thus, the frame 760 may move vertically while being spaced apart from the inner circumferential surface of the first cyclone part 110.

The cleaning part 770 may be made of an elastically deformable material. For example, the cleaning part 770 may be made of a rubber material.

The cleaning part 770 may have a ring shape so that the cleaning part 770 clean the entire circumference of the cylindrical filter part 130. For another example, the cleaning part 770 may be made of a silicon or fiber material.

The movable part 750 may move from the first position, which is the standby position, to a second position.

The cleaning part 770 may clean the outer surface of the filter part 130 while being standby at a position that is away from the filter part 130 in the first position and moving to the second position in the cleaning process.

For example, the cleaning part 770 may be coupled to the frame 760 by insert-injection.

The frame 760 may further include a pressing rib 766 extending downward.

The pressing rib 766 may be provided to be rounded in a circumferential direction of the frame 760.

The pressing rib 766 serves to pressurize the dust stored in the dust container 112 downward while the movable part 750 descends.

The frame 760 may further include a coupling part 767 extending outward from the pressing rib 766.

The coupling part 767 may protrude horizontally from the pressure rib 766. For example, the coupling part 767 may extend horizontally from a lower end of the pressing rib 766.

The second transfer part 730 may be connected to the coupling part 767.

A buffer 734 may be coupled to the second transfer part 730. The second transfer part 730 may be coupled to pass through the buffer 734. The buffer 734 may be seated on a top surface of the coupling part 767 in a state of being coupled to the second transfer part 730.

The second transfer part 730 may pass through an upper wall of the protruding body 180.

The buffer 734 absorbs an impact generated when the movable part 750 contacts the upper wall of the protruding body 180 while the movable part 750 moves from the second position to the first position to reduce noise to be generated.

The frame 760 may further include a frame guide 765 extending downward from a position spaced apart from the pressing rib 766.

The frame guide 765 may include a guide surface 765*a* that is flat. The guide surface 765*a* may guide a spiral flow of air while the air is introduced through the suction part 5.

If the structure for compressing the dust container 112 is applied according to an embodiment, when the dust container 112 is filled with dust, a volume of the dust may be reduced by compressing the dust.

Thus, it is not necessary to frequently empty the dust container 112 by the dust compression, and a phenomenon in which dust is blown when the dust is empty is reduced.

However, since the structure for compressing the dust is provided in the dust container 112, the dust may be introduced into the elevation space in which the second transfer part 730 connected to the movable part 750 moves.

Particularly, in the dust container 112, when the movable part 750 descends, the elevation space above the movable part 750 is exposed, and dust is introduced into the exposed elevation space.

As described above, when the dust of the dust container 112 is introduced into the elevation space of the second transfer part 730, the dust may act as an obstacle to the elevation operation of the movable part 750, and thus, the elevation operation of the movable part 750 may not be smoothly performed.

Particularly, when the movable part 750 descends, the elevation operation of the movable part 750 may be disturbed due to the dust caught between the second transfer part 730 and the elevation space.

FIGS. 8 to 11 are perspective views illustrating a dust introduction prevention structure provided on an inlet of an elevation groove according to various embodiments.

Hereinafter, referring to the drawings, a structure for blocking dust to prevent the dust within the dust container from being introduced into the elevation groove 190 defined in the dust container 112 when the movable part 750 is elevated will be described.

Referring FIGS. 8 to 11, the dust container 112 has the elevation groove 190 defined to be recessed outward from the inner surface thereof.

Here, the protruding body 180 protruding outward by the elevation groove 190 may be disposed on the outer surface of the housing 10. That is, the protruding body 180 protruding outward from the outer surface of the housing 10 may be provided by the elevation groove 190 defined to be recessed outward from the inside of the dust container 112.

The elevation groove 190 extends in the vertical direction. The elevation groove 190 may be provided in a straight line.

The elevation groove 190 serves as the elevation space of the second transfer part 730 connected to the movable part 750. At least a portion of the second transfer part 730 may be accommodated in the elevation groove 190 and may be supported by the elevation groove 190 to guide the elevation operation.

During the elevation operation of the movable part 750, the second transfer part 730 may be accommodated in the elevation groove 190.

The movable part 750 may move vertically while being reciprocated between the upper and lower ends of the dust container 112.

However, since the elevation groove 190 is exposed to the inside of the dust container 112, dust and foreign substances in the dust container 112 may be introduced into the elevation groove 190.

As described above, when the dust of the dust container 112 is introduced into the elevation groove 190, the dust may act as an obstacle to the elevation operation of the movable part 750, and thus, the elevation operation of the movable part 750 may not be smoothly performed.

Particularly, in the state in which the movable part 750 descends, the elevation operation of the movable part 750 may be disturbed due to the dust or foreign substances introduced into the elevating groove 190.

In this embodiment, partition members 310, 320, 330, and 340 provided at a side of an inlet 191 of the elevation groove 190 to partition the inner space of the dust container 112 and the inner space of the elevation groove from each other, thereby preventing the dust or foreign substances from being introduced into the elevation groove 190 may be provided.

Also, the partition members 310, 320, 330, and 340 may have slits along a vertical direction so that the connection part connecting the movable part 750 to the second transfer part 730 passes.

Also, each of the slits may be selectively opened and closed by the elevation operation of the connection part.

Also, when the connection part descends, the slit may be closed, and when the connection part ascends, the slit may be opened.

Also, each of the partition members 310, 320, 330, and 340 may be made of a cushion material having elasticity or flexibility.

Also, the partition members 310, 320, 330, and 340, may be made of a brushed material.

Also, the partition members 310, 320, 330, and 340 may be made of a rubber or silicone material.

Also, the partition members 310, 320, 330, and 340 are provided at both sides of the inlet 191 side of the elevation groove 190, and ends in which the slit is provided may at least partially overlap each other.

Also, the partition members 310, 320, 330, and 340 are provided at both sides of the inlet 191 side of the elevation groove 190, and ends in which the slit is provided may at least partially surface-contact each other.

Here, the partition members 310, 320, 330, and 340 provided on both the sides of the elevation groove 190 may be disposed symmetrical to each other on both sides with respect to the slit.

Also, at least a portion of each of the partition members 310, 320, 330, and 340 provided on both the sides of the elevation groove 190 may have a curved surface. Also, at least a portion of each of the partition members 310, 320, 330, and 340 may protrude toward the inner space of the dust container 112. Also, at least a portion of each of the partition members 310, 320, 330, and 340 may protrude toward the inner space of the elevation groove 190.

Also, at least a portion of each of the partition members 310, 320, 330, and 340 provided at both the sides of the elevating groove 190 may have a flat shape.

Also, the total sum of the horizontal lengths of the partition members 310, 320, 330, and 340 provided on both the sides of the elevation groove 190 may be longer than the horizontal length of the elevation groove 190.

Figure 8:
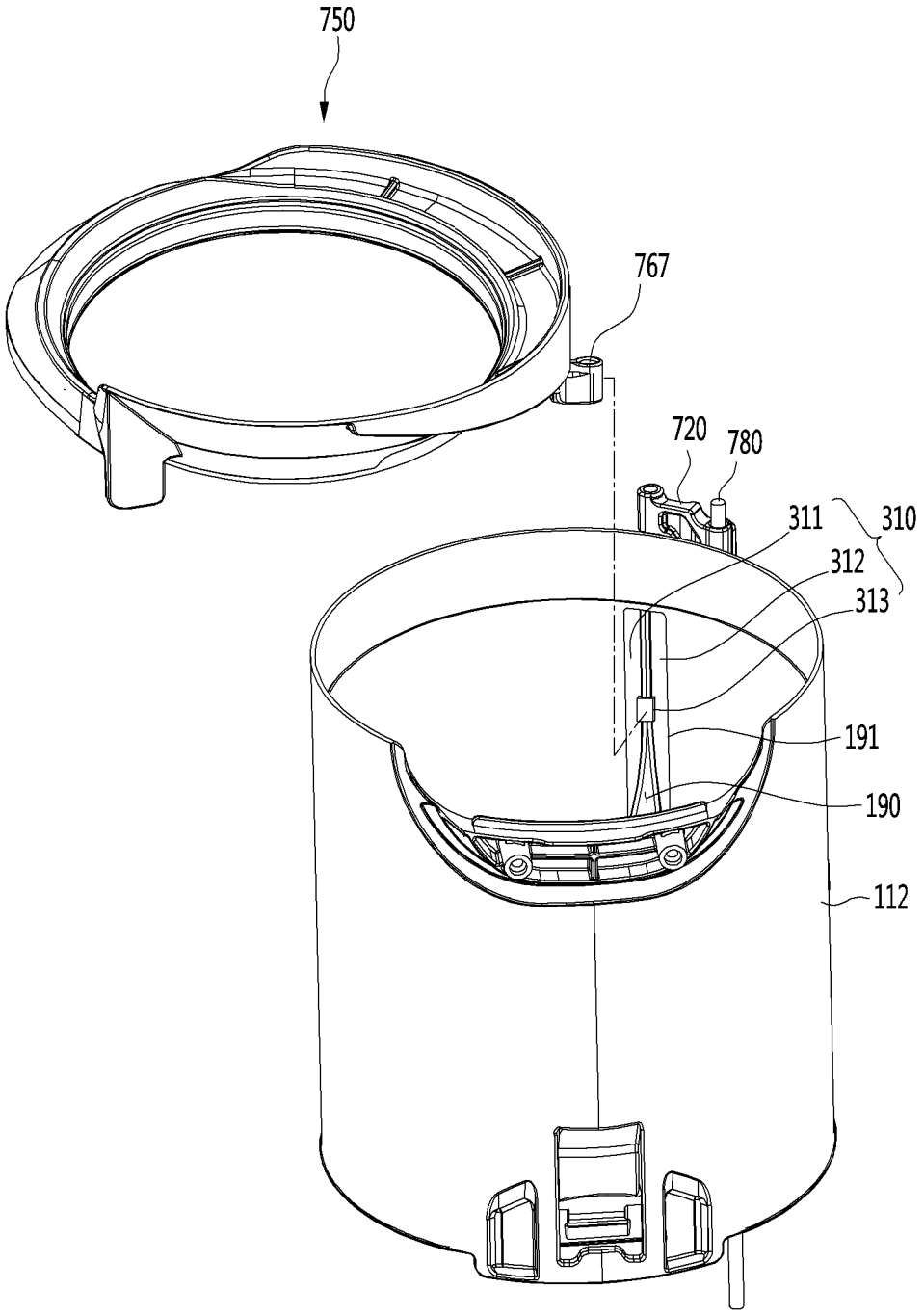
FIGS. 8 to 11 are perspective views illustrating a dust introduction prevention structure provided on an inlet of an elevation groove according to various embodiments.

Referring to FIG. 8, the partition member 310 may be provided in a zipper lock (Ziploc) manner.

Here, the 'zipper lock (Ziploc)' may be applied to a variety of known zipper lock structure to open and close the open upper side of the pouch.

In detail, the partition member 310 includes blocking films 311 and 312 which are attached to both the sides of the elevation groove 190, respectively.

Also, a slit is defined between the blocking films 311 and 312.

Also, facing ends of the blocking films 311 and 312, i.e., both ends defining the slits may be opened and closed by the elevation pieces 313.

Here, the elevation piece 313 may connect the coupling part 767 to the second transfer part 730.

That is, one side of the elevation piece 313 may be connected to the coupling part 767, and the other side of the elevation piece 313 may be connected to the second transfer part 730.

Thus, when the user presses the manipulation part 710, the second transfer part 730 descends, and the elevation piece 313 and the coupling part 767 descend. In addition, the movable part 750 also descends.

Here, the elevation piece 313 is elevated together with the second transfer part 730 and the movable part 750 to open or block a space between the blocking film 311 and 312.

For example, when the manipulation part 710 descends, the elevation piece 313 descends to block the space between the blocking films 311 and 312, and as a result, the inlet 191 of the elevation groove 190 is blocked. Thus, when the movable part 750 descends, the introduction of dust and foreign substances from the dust container 112 into the elevation groove 190 may be prevented.

On the other hand, when the second transfer part 730, the elevation piece 313, and the movable part 750 ascend, the space between the blocking film 311 and 312 is expanded, and thus, the elevation groove 190 is opened to the inside of the dust container 112.

Therefore, in the state in which the second transfer part 730, the elevation piece 313, and the movable part 750 ascend, the dust and foreign substances of the dust container 112 may be essentially introduced into the elevation groove 190.

However, the dust introduced into the elevation groove 190 is pushed downward by the second transfer part 730 when the movable part 750 descends.

Also, the dust pushed downward by the second transfer part 730 may be removed from the elevation groove 190 and collected in the dust container 112.

For reference, the 'connection part' may mean the elevation piece 313 and the coupling part 767.

For another example, when the manipulation part 710 is elevated, i.e., when the manipulation part 710 ascends or descends, the elevation piece 313 may be elevated to block the space between the blocking films 311 and 312. Thus, when the movable part 750 ascends, the introduction of dust and foreign substances from the dust container 112 into the elevation groove 190 may be prevented.

Figure 9:
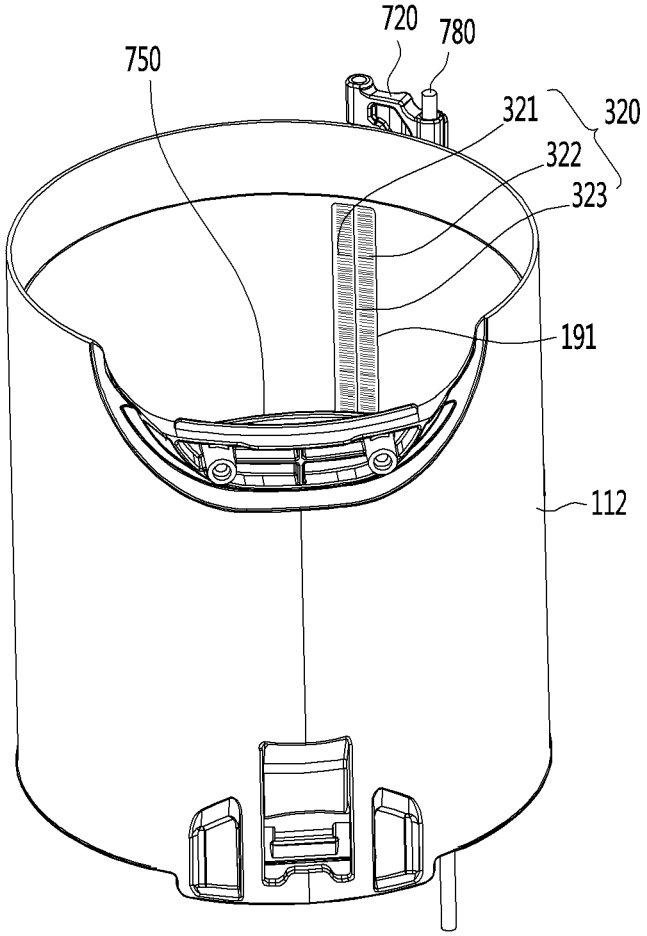

Referring to FIG. 9, the partition member 320 may be made of a brushed material. For example, the partition member 320 may be made of a cotton flannel material.

In detail, the partition member 320 includes blocking films 321 and 322 which are attached to both sides of the elevation groove 190, respectively.

Also, a slit 323 is defined between the blocking films 321 and 322.

A coupling part 767 connecting the movable part 750 to the second transfer part 730 may pass through the slit 323. Thus, when the manipulation part 710 is pressed, the second transfer part 730 descends, and the coupling part 767 may descend along the slit 232.

Also, when the coupling part 767 descends as described above, the movable unit 750 may descend to compress dust.

According to the foregoing embodiment, the inlet of the elevation groove 190 may be blocked regardless of whether the movable part 750 is elevated due to the blocking films 321 and 322. Also, the introduction of the dust and foreign substances in the dust container 112 into the elevation groove 190 may be prevented.

For reference, the 'connection part' may mean the coupling part 767.

Figure 10:
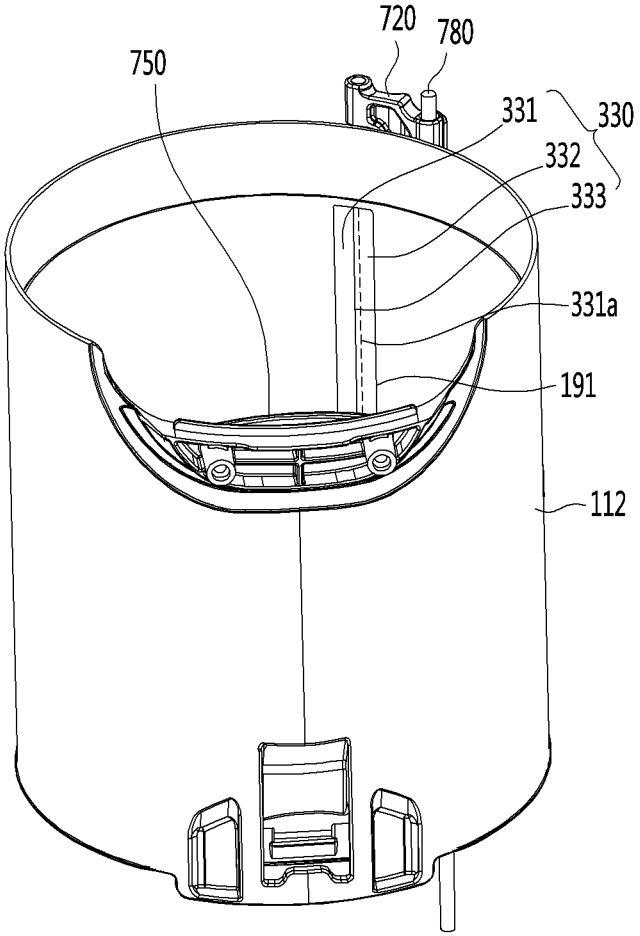

Referring to FIG. 10, the partition member 330 may be made of an elastic material such as rubber or silicon.

The partition member 330 includes blocking films 331 and 332 which are attached to both sides of the elevation groove 190, respectively.

A slit 333 is defined between the blocking films 331 and 332.

A coupling part 767 connecting the movable part 750 to the second transfer part 730 may pass through the slit 323. Thus, when the manipulation part 710 is pressed, the second transfer part 730 descends, and the coupling part 767 may descend along the slit 333.

Also, when the coupling part 767 descends as described above, the movable unit 750 may descend to compress dust.

According to the foregoing embodiment, the inlet of the elevation groove 190 may be blocked regardless of whether the movable part 750 is elevated due to the blocking films 331 and 332. Also, the introduction of the dust and foreign substances in the dust container 112 into the elevation groove 190 may be prevented.

Also, ends of the blocking layers 331 and 332, in which the slit 333 is defined, may at least partially overlap each other.

Referring to FIG. 9, since the ends of the blocking films 331 and 332 overlap each other, an end 331*a* (dashed line) of the blocking film 331 on the left blocking film 331 may be hidden behind the right blocking film 332.

Also, the blocking films 331 and 332 are provided at both sides of the inlet 191 side of the elevation groove 190, and ends in which the slit 333 is defined may at least partially surface-contact each other.

As described above, when the adjacent ends of the blocking films 331 and 332 attached to the inlet 191 of the elevation groove 190 overlap each other or surface-contact each other, the slit 333 may be more surely blocked. Therefore, the phenomenon that the dust or foreign substances in the dust container 112 are introduced into the elevation groove 190 may be more surely prevented through the slit 333.

On the other hand, even when the ends of the blocking films 331 and 332 overlap each other or surface-contact each other, since each of the blocking films 331 and 332 is made of an elastic material, the coupling part 767 connecting the movable part 750 to the second transfer part 730 may be elevated while passing through the slit 333.

For reference, the 'connection part' may mean the coupling part 767.

Figure 11:
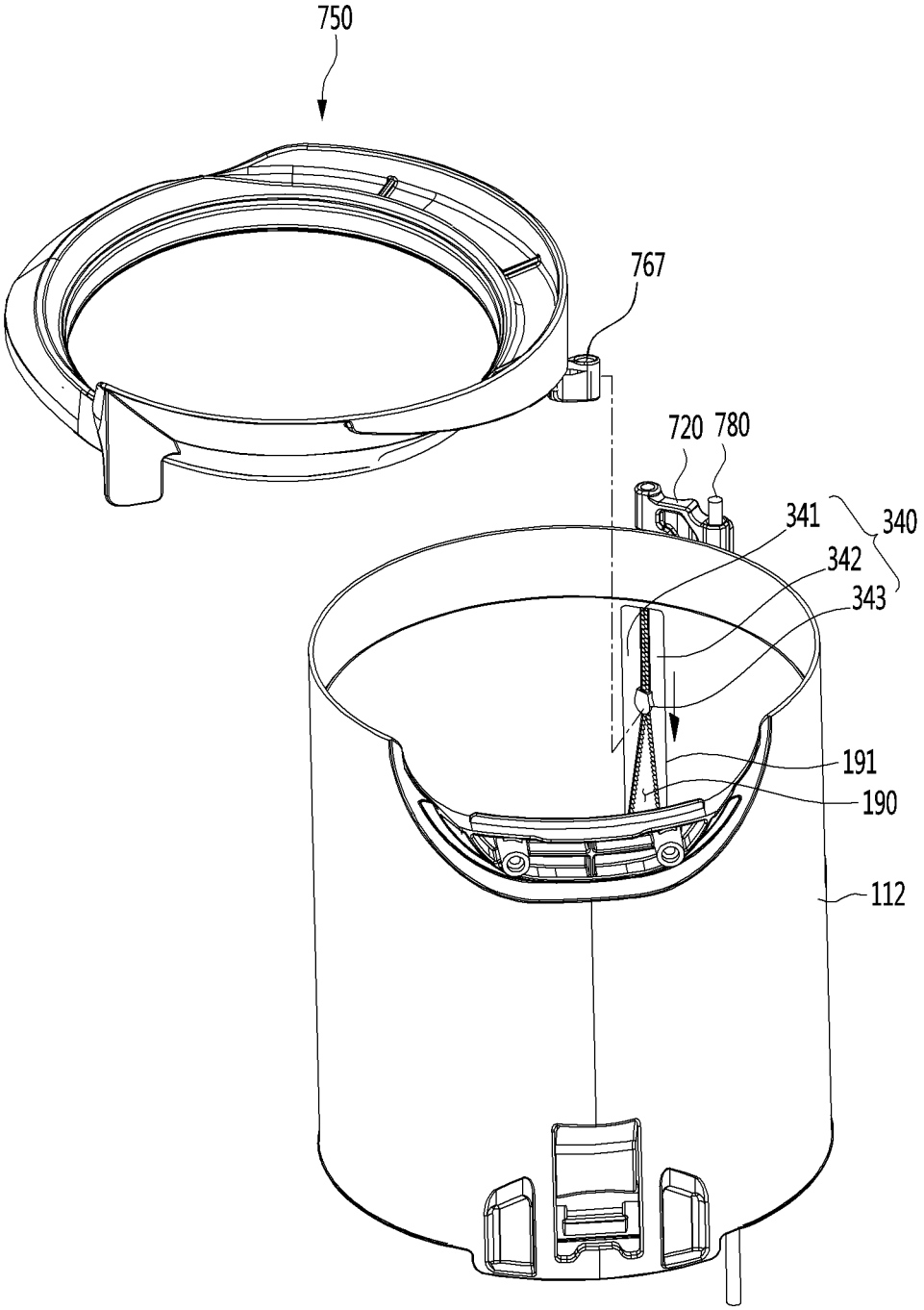

Referring to FIG. 11, the partition member 340 may be provided in a zipper manner.

Here, the 'zipper' may correspond to a variety of well-known zippers configured to open and close while being engaged with each other.

In detail, the partition member 340 includes blocking films 341 and 342, which are attached to both sides of the elevation groove 190, respectively.

A slit is defined between the blocking films 341 and 342.

Also, facing ends of the blocking films 341 and 342, i.e., both ends defining the slits may be opened and closed by the elevation pieces 343.

Here, the elevation piece 343 may connect the coupling part 767 to the second transfer part 730.

That is, one side of the elevation piece 343 may be connected to the coupling part 767, and the other side of the elevation piece 343 may be connected to the second transfer part 730.

Thus, when the user presses the manipulation part 710, the second transfer part 730 descends, and the elevation piece 343 and the coupling part 767 descend. In addition, the movable part 750 also descends.

Here, the elevation piece 343 is elevated together with the second transfer part 730 and the movable part 750 to open or block a space between the blocking film 341 and 342.

For example, when the manipulation part 710 descends, the elevation piece 313 descends to block the space between the blocking films 341 and 342, and as a result, the inlet 191 of the elevation groove 190 is blocked. Thus, when the movable part 750 descends, the introduction of dust and foreign substances from the dust container 112 into the elevation groove 190 may be prevented.

On the other hand, when the second transfer part 730, the elevation piece 343, and the movable part 750 ascend, the space between the blocking films 341 and 342 may be expanded, and thus, the elevation groove 190 may be opened to the inside of the dust container 112.

Therefore, in the state in which the second transfer part 730, the elevation piece 343, and the movable part 750 ascend, the dust and foreign substances of the dust container 112 may be essentially introduced into the elevation groove 190.

However, the dust introduced into the elevation groove 190 is pushed downward by the second transfer part 730 when the movable part 750 descends.

Also, the dust pushed downward by the second transfer part 730 may be removed from the elevation groove 190 and collected in the dust container 112.

For reference, the 'connection part' may mean the elevation piece 343 and the coupling part 767.

For another example, when the manipulation part 710 is elevated, i.e., when the manipulation part 710 ascends or descends, the elevation piece 343 may be elevated to block the space between the blocking films 341 and 342. Thus, when the movable part 750 ascends, the introduction of dust and foreign substances from the dust container 112 into the elevation groove 190 may be prevented.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cleaner comprising:

a housing having an upper side and a lower side, the lower side defining a dust container with a suction opening formed therein;

a filter part configured to filter particles from air suctioned through the suction opening, the filter being spaced apart from an inner surface of the housing;

a movable part provided in a space located between an outer surface of the filter part and the inner surface of the housing, the moveable part configured to be elevated between a first position and a second position;

a manipulation part having at least a portion thereof that is exposed outside of the housing, the manipulation part configured to be moved by a user's manipulation; and a transfer unit having at least a portion thereof that is accommodated inside the housing, the transfer unit configured to connect the manipulation part to the movable part, wherein the dust container has an elevation groove formed therein, the elevation groove extending in a vertical direction and recessed outward from an inner surface of the dust container, and wherein a partition member provided at an inlet-side of the elevation groove to partition an inner space of the dust container from an inner surface of the elevation groove, and wherein the partition member has a slit extending in a vertical direction, and wherein the slit is selectively opened and closed by an elevation operation of the connection part.

2. The cleaner according to claim 1, wherein the transfer unit comprises:

a first transfer part and a second transfer part, wherein the first transfer part is configured to connect an upper side of the second transfer part to an upper side of the manipulation part, and wherein the second transfer part extends upward from one side of the movable part.

3. The cleaner according to claim 2, wherein, when the movable part is elevated, at least a portion of the second transfer part is accommodated into and guided by the elevation groove.

4. The cleaner according to claim 3, wherein the slit is configured to receive the movable part and the connection part of the second transfer part.

5. The cleaner according to claim 4, wherein the slit closes when the connection part descends, and the slit opens when the connection part ascends.

6. The cleaner according to claim 4, wherein the partition member comprises a cushion material having elasticity.

7. The cleaner according to claim 4, wherein the partition member comprises a brushed material.

8. The cleaner according to claim 4, wherein the partition member comprises a rubber or silicon material.

9. The cleaner according to claim 4, wherein the partition member is provided at each side of the inlet-side of the elevation groove, wherein end portions of the partition member in which the slit is defined at least partially overlap each other.

10. The cleaner according to claim 4, wherein the partition member is provided at each side of the inlet-side of the elevation groove, wherein end portions of the partition member in which the slit is defined at least partially contact each other.

11. The cleaner according to claim 1, wherein the portion of the manipulation part that is exposed outside of the housing extends in a horizontal direction.

12. The cleaner according to claim 1, further comprising an elastic member configured to provide an elastic force to the manipulation part or the transfer unit.

13. The cleaner according to claim 12, wherein the elastic force provided by the elastic member pushes the manipulation part upward.

14. The cleaner according to claim 13, wherein a support bar extending vertically is provided outside of the housing, and the elastic member is inserted into an outer circumferential surface of the support bar.

15. The cleaner according to claim 1, wherein a handle part is disposed outside of the housing, and the manipulation part is disposed adjacent to one side of the handle part.

16. The cleaner according to claim 1, wherein the slit closes when the connection part descends, and the slit opens when the connection part ascends.

17. A cleaner comprising:

a housing having an upper side and a lower side, the lower side defining a dust container with a suction opening formed therein;

a filter part configured to filter particles from air suctioned through the suction opening, the filter being spaced apart from an inner surface of the housing;

a movable part provided in a space located between an outer surface of the filter part and the inner surface of the housing, the moveable part configured to be elevated between a first position and a second position;

a manipulation part having at least a portion thereof that is exposed outside of the housing, the manipulation part configured to be moved by a user's manipulation;

a transfer unit having at least a portion thereof that is accommodated inside the housing, the transfer unit configured to connect the manipulation part to the movable part, the transfer unit comprising a first transfer part and a second transfer part, the first transfer part configured to connect an upper side of the second transfer part to an upper side of the manipulation part, and the second transfer part extending upward from one side of the movable part;

an elevation groove formed in the dust container, the elevation groove extending in a vertical direction and recessed outward from an inner surface of the dust container; and a partition member provided at an inlet side of the elevation groove to partition an inner space of the dust container from an inner surface of the elevation groove, the partition member having a slit extending in a vertical direction, the slit configured to receive the movable part and the connection part of the second transfer part, wherein the slit is selectively opened and closed by an elevation operation of the connection part.

* * * * *